US006338388B1

(12) United States Patent
Winkler

(10) Patent No.: US 6,338,388 B1
(45) Date of Patent: Jan. 15, 2002

(54) LOAD BEARING PUMP ROTOR TAG BAR

(75) Inventor: Steven T. Winkler, Calgary (CA)

(73) Assignee: Integrated Production Services Ltd., Calgary (CA)

( * ) Notice: Subject to any disclaimer, the term of this patent is extended or adjusted under 35 U.S.C. 154(b) by 0 days.

(21) Appl. No.: 09/583,568

(22) Filed: May 31, 2000

(30) Foreign Application Priority Data

Jun. 4, 1999 (CA) ..... 2273753

(51) Int. Cl.[7] ..... E21B 23/01
(52) U.S. Cl. ..... 166/382; 166/67; 418/48
(58) Field of Search ..... 166/382, 105, 166/369, 117.7, 67, 69; 418/48

(56) References Cited

U.S. PATENT DOCUMENTS 4,901,793 A * 2/1990 Weber ..... 166/68.5
5,209,294 A * 5/1993 Weber ..... 166/105
5,551,510 A * 9/1996 Mills ..... 166/68
5,653,290 A * 8/1997 Bland ..... 166/381
5,697,768 A * 12/1997 Mills ..... 417/365
5,725,053 A * 3/1998 Weber ..... 166/105

FOREIGN PATENT DOCUMENTS

CA 1057120 * 9/1979 ..... 103/20

* cited by examiner

*Primary Examiner*—Frank Tsay
(74) *Attorney, Agent, or Firm*—Sean W Goodwin

(57) ABSTRACT

A rotating tag bar is positioned below a progressive cavity pump stator for supporting at least a portion of a rod string a rotor. A tubular housing is secured to the stator and is fitted with a rotatable platform. The platform blocks downward stretch of the rotor and then rotatably support the rotor on a thrust bearing. Thereby, rotor-imposed loads on the platform translate into tensile loads directed into the stator, which is suspended from tubing string, lessening the load on the rod string and thereby both reducing the need for extreme accuracy in rotor positioning and reducing rod string and tubing wear. Optionally, a no-turn tool transmits load from the stator into the casing. In operation, the rotor is landed to contact the platform. The rotor is then lifted a distance less than the anticipated stretch so that when in operation, the rotor sets down on the platform and transfers at least a portion of the rod string load into stator.

9 Claims, 4 Drawing Sheets

Fig. 3
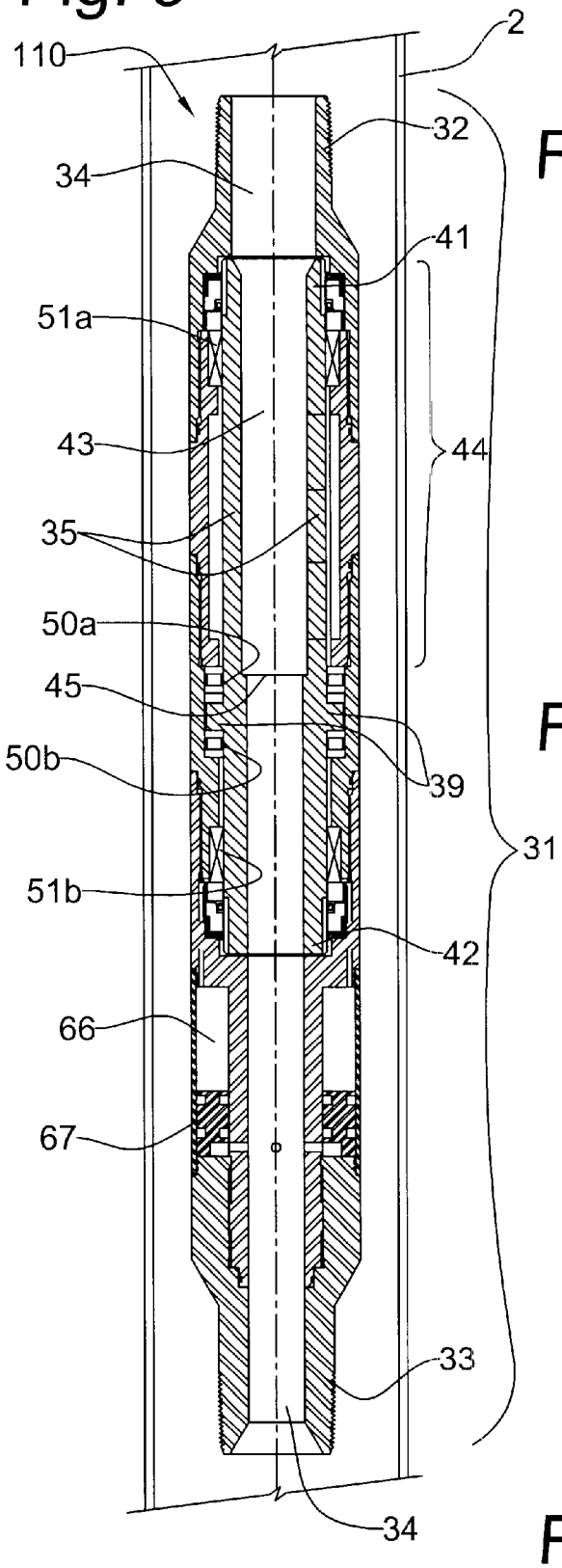
Fig. 4a
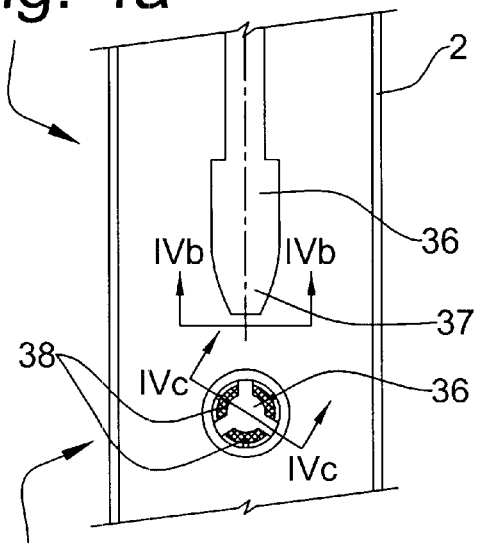
Fig. 4b
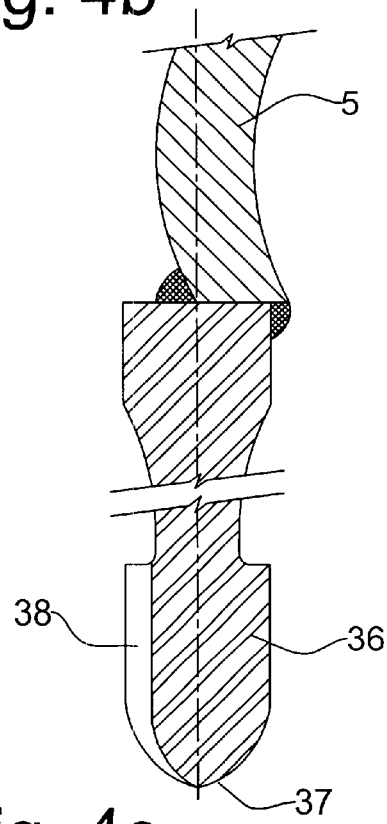
Fig. 4c 110
2
60
61
62
63
64
65
66
67
68
69
34
51a
35
50a
39
50b
51b
67
70
68

0
100
1
5
31
36
35
45

LOAD BEARING PUMP ROTOR TAG BAR

FIELD OF THE INVENTION

The present invention relates in one aspect to a method for positioning the rotor in a downhole progressive cavity pump prior to its use. In another aspect, apparatus connected to the pump stator is capable of resisting downward thrust of the rotor, thereby relieving tension in the supporting rod string.

BACKGROUND OF THE INVENTION

A progressive cavity pump is located within an oil well, positioned at the bottom end of a production tubing string which extends down the bore of the well. The pump forces fluids up the bore of the tubing string to the surface. The pump comprises a pump stator hung at the end of the tubing string, and a rotor which is both suspended and rotationally driven by a sucker rod string extending downwardly through the tubing string's bore.

The rotor is a helical element which rotates within a corresponding helical passage in the stator.

The rotor rotates in the stator and drives fluids upwardly. A downward reaction force is created, driving the rotor downwardly. Further, the rotor hangs from the rod string. The combined force of the rod string weight and the pumping reaction causes the rod string to be under significant tension. As a result, the long length of elastic sucker rod stretches and the bottom end of the rotor moves slightly downhole to a lower elevation, perhaps even extending out of the bottom of the pump.

Conventionally, a stop is located at the bottom of the stator and is used to set the initial elevation of the rotor. This stop is known as a tag bar, which extends across the pump's inlet, minimally impeding the fluid inlet and prevents the rotor from exiting the stator. Once the rotor contacts the tag bar (indicated by a lessening of the suspended weight), then the rod string and rotor are lifted slightly (usually about 1 foot–1½ feet) in anticipation of providing enough clearance that, even when elongated during operation, the rotor will not contact the tag bar again.

Often however, the estimate of dynamic stretch is often inaccurate and the rotor ends up contacting the tag bar during operation anyway. The result is rotating to stationary, metal-to-metal damage; both to the tag bar and possibly to the rotor.

Even if the tag bar and rotor do not contact one another, another result of high tension is the natural tendency of the rod string to assume the straightest possible path, regardless of the profile of the tubing string. The result is a large amount of wear on the tubing string wherever the rod contacts a deviation in the tubing, such as through curves. Rotation stabilizers and centralizers are some of the prior art devices which passively deal with rod tension, deviation and wear.

In U.S. Pat. Nos. 5,209,294 and 5,725,053, both to J. Weber, rotor placer apparatus is disclosed which is located about 30 feet above the pump and which both suppresses vibration from the eccentric rotor and absorbs the downward thrust from the rotor. One perceived difficulty these devices is the quantity of hardware provided and its impact on the flow passages, restricting flow of fluid up the tubing string.

So, there are several demonstrated disadvantages associated with the use of progressive cavity pumps, in particular, due to the movement of the rotor associated with the pumping reaction and the known prior art remedies provided to date.

SUMMARY OF THE INVENTION

A supportive platform is positioned beneath the bottom of the rotor of a downhole progressive cavity pump. The platform can rotate, supported by a thrust bearing which is itself supported by a tensile housing secured to the bottom of the stator. Thereby, rotor-imposed loads on the platform translate into tensile loads directed into the stator and tubing string, lessening the load on the rod string and thereby both reducing the need for extreme accuracy in rotor positioning and reducing rod string and tubing wear. Preferably, a no-turn tool transmits load from the stator into the casing.

In one broad aspect of the invention, a rotating tag bar is provided comprising a housing connected to the bottom end of the stator which contains a platform which supports the bottom of the rotor and transferring at least a portion of the weight of the rotor and rod string into a bearing assembly and thus into the housing, stator and tubing string.

Preferably, the platform is a sleeve having a bore which is sized to accept a concentric prong fitted to the bottom of the eccentric rotor. The prong extends part way into the sleeve's bore and then bears against a stop. The preferred sleeve is supported in the housing using at least one thrust bearing and stabilized using radial bearings. The prong is formed with flow passages to pass well fluid through the sleeve's bore.

The above apparatus results in a novel method of landing a screw pump rotor suspended from the end of a rod string, comprising: fitting the bottom of a stator with a rotating tag bar apparatus as described above; running in the rotor until its bottom end tags the sleeve stop; and lifting to position the rotor's bottom end off of the sleeve's stop a distance which is less than the anticipated stretch, so that when operated and the rotor and rod string, the bottom end of the rotor is supported by the rotating tag bar, lessening the load in the rod string. The positioning of the rotor before operation is no longer critical as contact is encouraged.

BRIEF DESCRIPTION OF THE DRAWINGS

FIG. 3 is a cross-sectional view of a preferred embodiment of a rotating tag bar, shown in isolation from the stator from which it is suspended, and the rotor's prong prior to engagement;

FIG. 4*a* is a cross-sectional view of the prong;

FIG. 4*b* is a bottom view of the prong along lines IVb—IVb of FIG. 4*a;*

FIG. 4*c* is a partial cross-sectional view of the prong of FIG. 4*a* sectioned along lines IVc—IVc;

FIG. 5*a* is an assembled view and FIG. 5*b* is an axially exploded view with the sleeve exploded laterally for clarity.

FIG. 6*a* illustrates landing of the rotor and prong wherein the prong tags the sleeve's stop;

FIG. 6*b* illustrates upward positioning the rotor prior to operation, both the tubing string and rod string supporting 100% of their own weights;

FIG. 6*c* illustrates the bottom of the rotor having lowered to the rotating tag bar use to rod string stretch on pumping; the tubing string bearing more than 100% of its own weight by partially supporting the rod string; and for comparison FIG. 6*d* illustrates a hypothetical case to demonstrate the equivalent greater extent of stretch if a rotating tag bar were not present.

DETAILED DESCRIPTION OF THE PREFERRED EMBODIMENT

Figure 1:
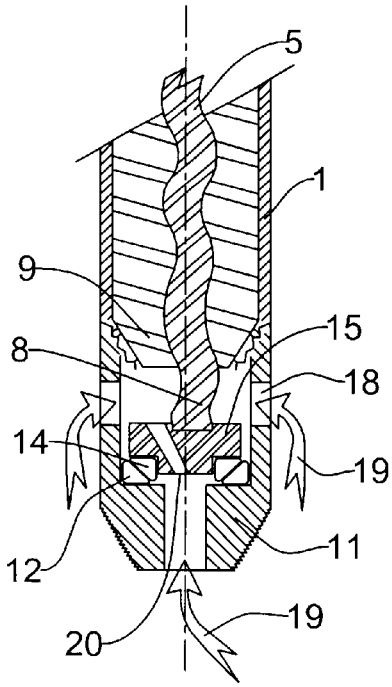
FIG. 1 is a partial side, cross-sectional schematic view of one embodiment of the invention illustrating an installation below a progressive cavity pump for engaging and supporting the bottom end of its rotor.
Figure 2:
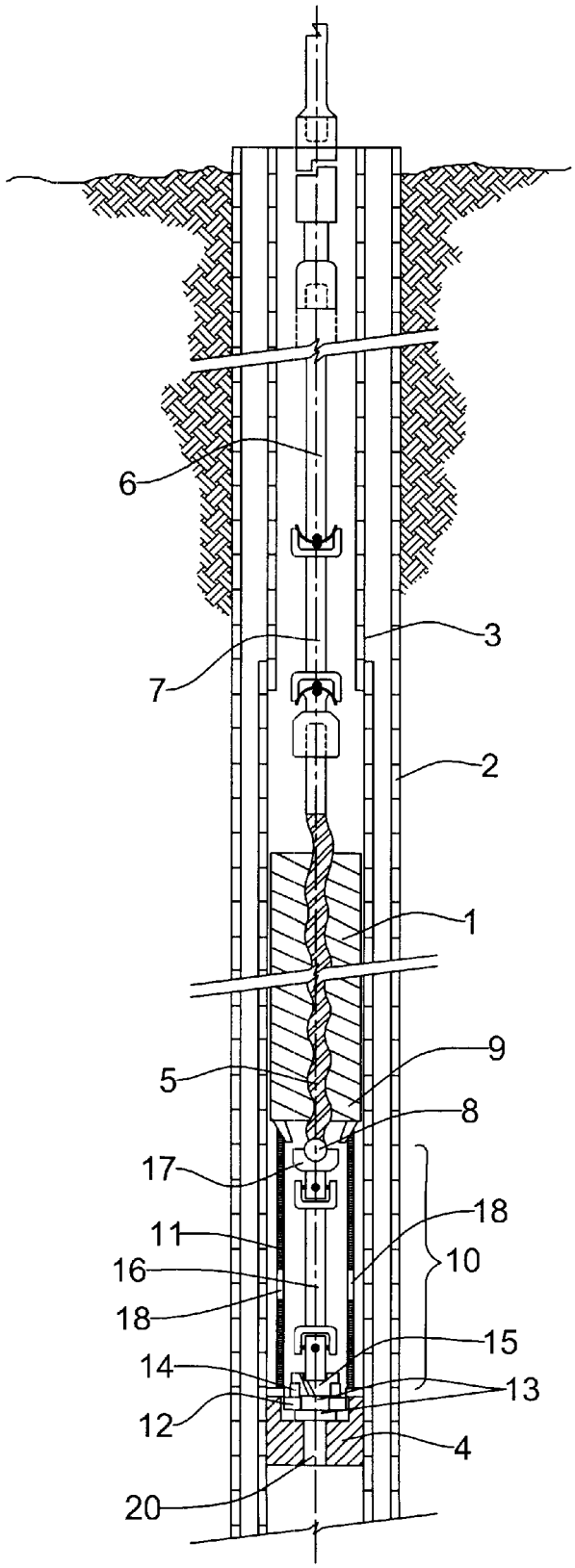
FIG. 2 a side, cross-sectional schematic view illustrating rod and tubing strings implementing another embodiment of the invention having a cross-over apparatus between the rotor and the tag bar platform.

Having reference to FIGS. 1 and 2, the stator 1 of a progressive cavity pump is located concentrically within the well casing 2 and is suspended from a production tubing string 3. The pump stator 1 is secured against reactive torque rotation, relative to the well casing, using a no-turn tool 4 such as that described in U.S. Pat. No. 4,901,793, issued Feb. 20, 1990 to J. Weber.

A rotor 5 is suspended from a string of sucker rod 6. A universal joint 7 or similar device may be placed between the rotor 5 and the rod string 6. The length of the string of sucker rod 6 is such that the rotor 5 seats into the downhole pump stator 1. The rotor 5 has a bottom end 8 which is inserted into the stator 1 and ends adjacent to the pump bottom 9.

As shown in FIG. 1, in a schematic sense, the bottom end 9 of the stator 1 is threaded into an improved tag bar assembly 10. A tensile tubular member 11 connects to the stator's bottom end 9 and extends downwardly to support the outer race 12 of a thrust bearing 13. The inner race 14 of the thrust bearing 13 supports a rotating platform 15. The platform 15 replaces the prior art, non-rotating tag bar with a rotating tag bar platform for supporting the axial load imposed by the rotating rotor 5 and transmitting the resulting loads into the stator 1, and tubing string 3, or through the no-turn tool 4 into the casing 2.

As shown in FIG. 2, in an alternate embodiment, due to the eccentric path of the end of the rotor 5, it is preferable to place an intermediate cross-over device 16, such as a universal joint, between the platform 15 and the bottom end 8 of the rotor 5. The cross-over device 16 has a connection 17 to the bottom 9 of the rotor 5 for supporting the compressive load imposed on it between the rotor's end 8 and the rotating platform 15.

In either embodiment, the rotating platform 15 does not impede flow of the fluid into the bottom 9 of the stator 1.

The platform 15 is substantially open, only having sufficient cross-sectional area to support the rotor 5 and to connect to the thrust bearing 13. Spacing the rotating platform 15 from the ends 8,9 of the rotor or stator further avoid interfering with fluid inflow into the stator 1. Additionally, the tubular member 11 need not be a continuous tubular structure, having openings 18 formed therein, thereby permitting fluids in the annulus 19 formed between the tubular member 11 and casing 2 to flow to the bottom of the stator 1. Further, flow ports 20 are formed around the periphery of the bottom 8 of the rotor 5.

More particularly, a specific embodiment of the invention is provided which embodies the objectives set forth above and also addresses the practical aspects of landing a rotor 5 in the stator 1 and dictating what tension to accept in the rod string 6.

Having reference to FIG. 3, a rotating tag bar 110 is provided wherein the tensile tubular member 11 comprises a tubular housing 31. The housing's upper end 32 connects to the stator 9 (not shown). The lower end 33 18 is adapted to connect to a no-turn tool 4 as necessary (also not shown).

The housing 31 forms a bore 34. Within the bore 34 is a sleeve 35 which is rotatable and supported on bearings 13 within the housing 31. The sleeve 35 forms the rotating platform 15. As shown in FIGS. 4*a* and 4*c*, the eccentric pump rotor bottom is fitted with a complementary concentric prong 36. The prong is affixed at the rotor's center of rotation, thereby minimizing eccentric loading into the sleeve 35 and housing 31. The prong 36 engages the sleeve 35 so that at least a portion of the rotor's load is transferred into the sleeve 35, through the bearing 13, and into the housing 31. The prong 36 has a leading tapered nose 37 for ease of engaging the sleeve's bore 34. In FIGS. 4*b*, 4*c*, the cross-section of the prong 36 is seen to be non-circular, having one or more fluid bypass ports 38 formed therein. Accordingly, when the prong engages the sleeve's bore 34, fluid can flow thereby and to the stator 1.

More specifically, sleeve 35 is forms a radially outward thrust shoulder 39 intermediate its upper inlet end 41 and bottom end 42. The sleeve 35 is cylindrically tubular, forming a bore 43, contiguous with bore 34. At the upper inlet end 41, the bore 43 forms an engagement portion 44 for insertably accepting the prong 36. Within the bore 43, and at the bottom of the engagement portion 44, a radially inward upset forms a shoulder or stop 45. The stop 45 engages the prong 36 and blocks further downward movement, thereby supporting the prong 36, rod 5 and rod string 6 thereabove.

The engagement portion 44 aids in a smooth axial transition between the landing of the rotor 5 versus the rotor 5 when operating. The engagement portion bore 43 can be contoured or helically fluted (not shown) to aid in engaging the prong 36.

The sleeve 35 is rotatably and axially supported with a system of seals and bearings 13. Bearings 50*a* and 50*b* are located either side of the thrust shoulder 39. These bearings 50*a*, 50*b* are capable of accepting and supporting some or all of the rotor thrust. Radial bearings 51*a*, 51*b* are positioned at the upper and lower ends 41,42 of the sleeve for stabilizing the sleeve during rotor operation.

Seals and a pressure compensated lubrication system ensure the bearing have the best opportunity for survival in adverse fluid conditions. To aid in assembly and installation of the sleeve, bearings and seals, the housing 41 is assembled from a plurality of tubular sub-housing components.

Figures 5A, 5B:
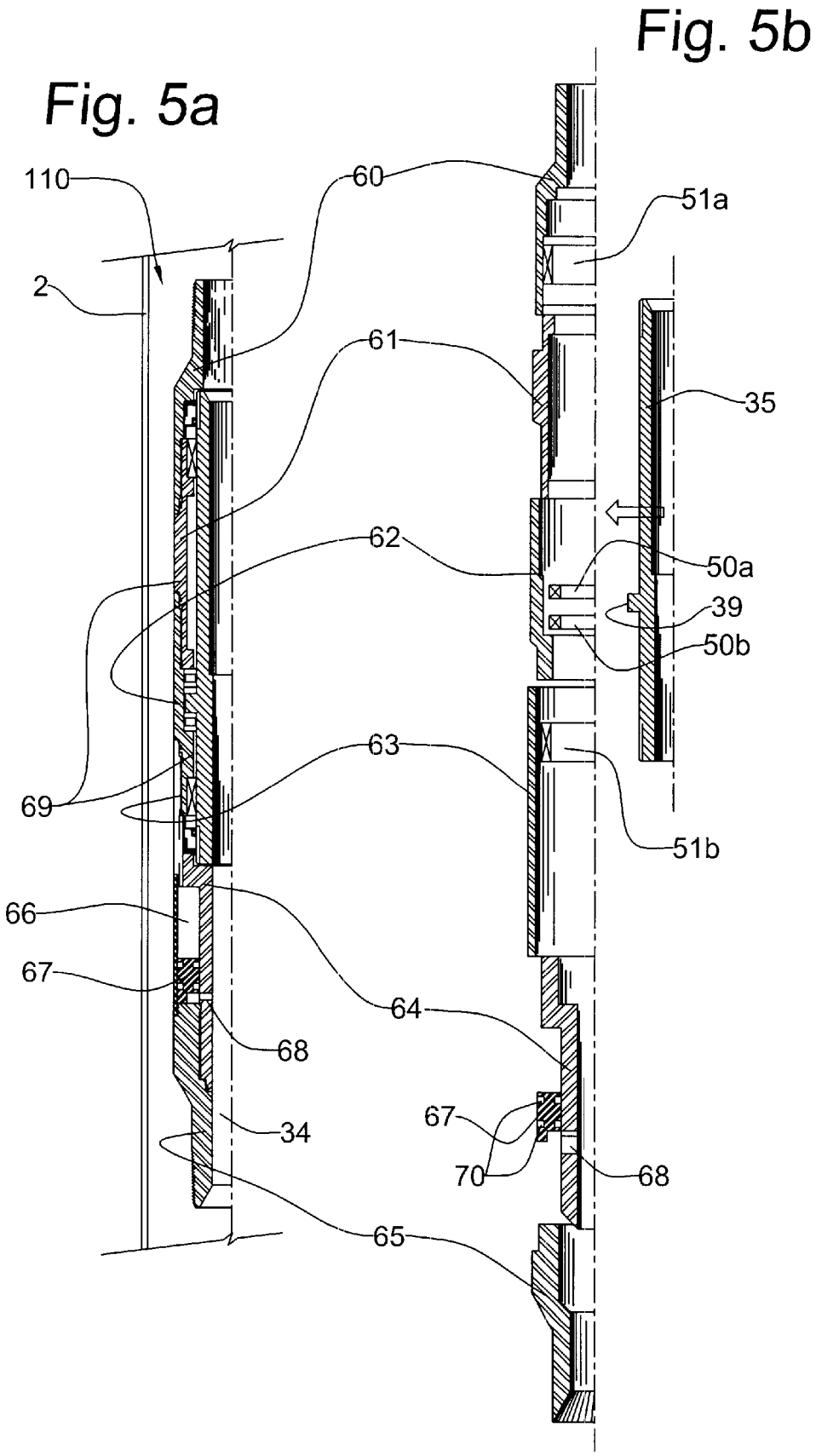
FIGS. 5*a* and 5*b* are simplified one half cross-sectional assemblies of the rotating tag bar of FIG. 3.

Having reference to FIGS. 5*a* and 5*b*, most preferably, the housing 41 is formed of a top sub 60 and a bottom sub 65 having threaded ends for connection to the stator's bottom 9 and a non-turn tool 4 (if used) respectively. The bottom of the top sub 60 is coupled to an intermediate upper sub 61, sandwiching the top radial bearing 51*a* axially therebetween. A center sub 62 couples with the intermediate upper sub 61, sandwiching the thrust bearings 50*a*,50*b*, thrust shoulder 39 and sleeve 35 to the intermediate upper sub 61. A barrel 63 couples the center sub 62 and the bottom sub 65. An intermediate lower sub 64 is coupled to the bottom sub and extends upwardly into the barrel 63, sandwiching the lower radial bearing to the center sub 62.

The barrel 63 and intermediate lower sub 64 forming an annular lubrication chamber 66 therebetween. An annular piston 67 is fitted to the chamber 66. At the lower end of the lubrication chamber, a passage 68 extends to the bore 34 for communicating with the well fluid. The upper end of the lubrication chamber has passageways 69 extending to each of the bearings 51*b*,50*b*,50*a*,51*a* for providing lubricant. The annular piston 67 is fitted with seals 70 to ensure that well fluid is not able to access the bearings. The piston 67 moves to equalize and compensate for pressure changes in the bore 37 and thereby avoid driving contaminants past the bearing protection seals 51*b*,51*a*.

Figures 6A, 6B, 6C, 6D:
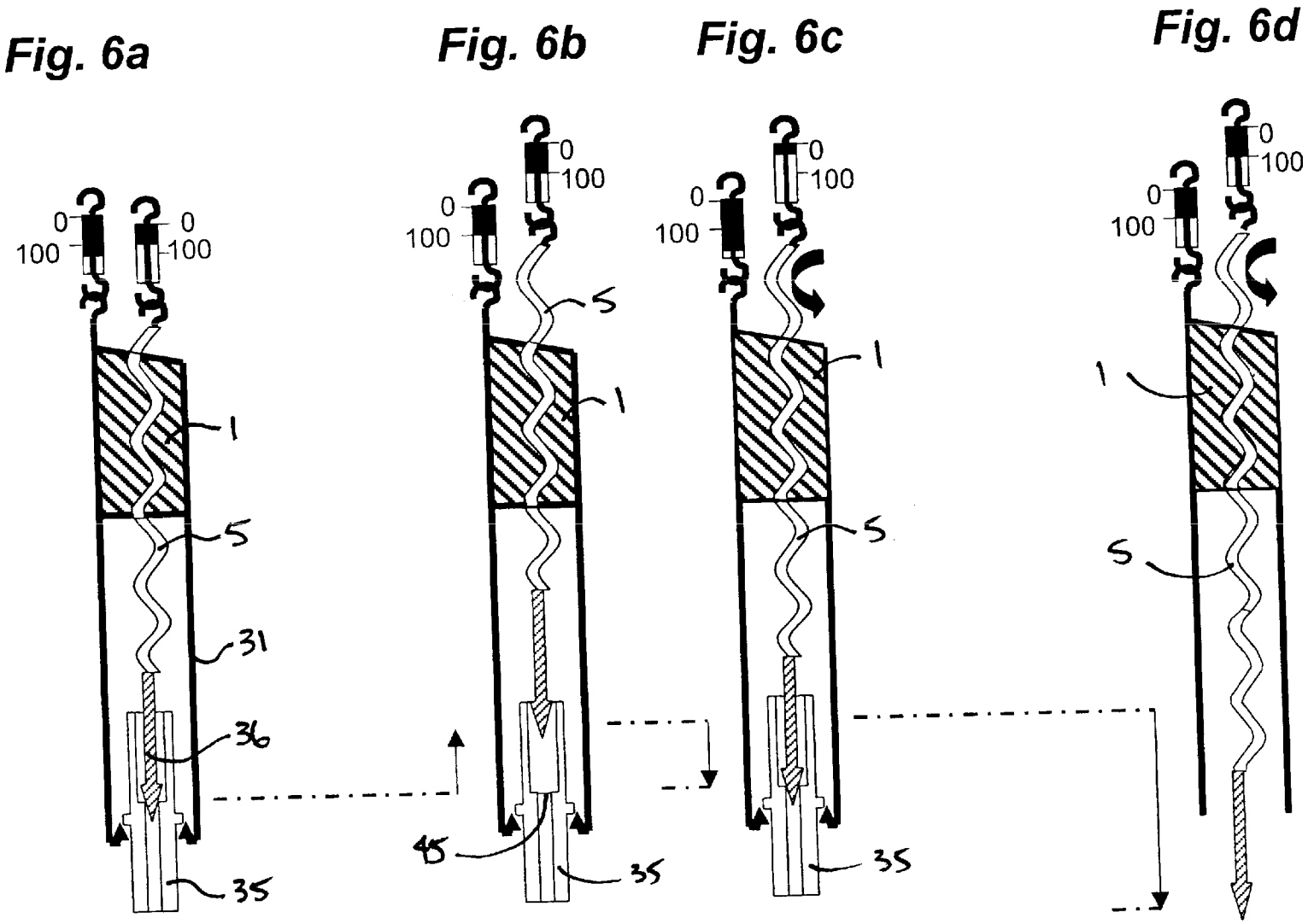
FIGS. 6*a*–6*d* are schematic representations of the rotating tag bar during landing and operation; the rotating tag bar being represented only by the sleeve for simplicity. More specifically.

Having reference to FIGS. 6*a* –6*c*, in operation, a pump stator is suspended from a tubing string. The stator is fitted with a rotating tag bar 110. For illustrative purposes, only the sleeve 35 and a representation of the housing 31 are shown. A fanciful tubing load indicator 81 signals whether more or less than 100% of the assembled tubing 3, stator 1 and housing 31 weight is being suspended. A fanciful rod string load indicator 82 signals whether more or less than 100% of the assembled rod string 6 and rotor 5 weight is being suspended.

Before the rotor 5 is landed, the tubing load indicator 81 reads 100%.

Having reference to FIG. 6*a*, the rotor 5 is fitted with a concentric prong 36 and lowered downhole on the rod string 5. The rotor 5 is lowered through the stator 1 until the prong 36 is landed in the rotating tag bar by contacting the sleeve's stop 45, indicated by the rotor load indicator 82 at less than 100%. Some of the rod string weight is transferred to the tubing string whose load indication is shown to increase beyond 100%.

Referring to FIG. 6*b*, the rod string is then lifted a predetermined amount, based on a calculation about how much the rod string will stretch in operation. The amount lifted will be a value less than the anticipated stretch amount, else the rotor prong 36 would not bear on the stop 45. At this point, the prong is suspended above the shoulder a distance less than that it is expected to stretch in operation (as suggested in FIG. 6*d*). The tubing string 3 again supports only 100% of its own weight. The prong 36 is preferably still located in the engagement section 44 so that on rotor rotation, the prong 36 is laterally supported in the sleeve 35.

Referring to FIG. 6*c*, as the rotor 5 and rod string 6 become axially loaded during pumping operation, the prong 36 lowers in the sleeve, contacting the stop 45. The rod string weight is then borne partially by the rotating tag bar which transfers the load to the tubing string. Accordingly, the fanciful load indicators 81,82 show that the tubing string 3 now carries greater than 100% of its weight and the rod string carries less than 100% of its weight.

For example, a ⅞" diameter at full pumping load is anticipated to experience an 18" stretch or extension in length in operation. Accordingly, one can lift the rotor about 6" off of the shoulder prior to starting the pump. As the pump begins to pump, the rotor and prong lower into the sleeve, contacting the shoulder when the rotor stretches 6" of the anticipated 18". The sleeves stop then begins and continues to absorb more and more of the weight of the rotor and rod string. Without the rotating tag bar, the prong would continue to drop a further 12" (FIG. 6*d*). That previous stretch amount of 12" is now supported by the tubing string and could be equivalent to transferring about ⅔ of the weight of the rod string and rotor to the tubing string.

The release of tension from the rod string has several beneficial effects. One effect is that contact wear between the rod string and tubing is diminished. Another effect is to increase tubing string tension. This places load on the threaded connections, including the stator to tubing string connection. The increased load significantly reduces the possibility of accidental unthreading during operation. Accordingly, the stator could now be operated without the need for a no-turn tool.

Advantages of the present invention include:

providing a tag bar which can accept rotor load in instances where the operating rotor position is below the bottom of the stator, normally destructive to conventional non-rotating tag bars;

the flow of fluid above the pump is not impeded and the present apparatus has a large fluid inlet capacity to provide fluid to the stator inlet;

the ability to accept rotor loads and relieve some of the tensile forces on the rod string and thereby reduce the load-related failures and wear on the string and production tubing; and the possibility of eliminating the need for a no-turn tool or torque anchor.

The embodiments of the invention for which an exclusive property of privilege is claimed are defined as follows:

1. A rotary tag bar apparatus for a rotary pump located in a well, the pump having a stator suspended from a tubing string, the stator having a bottom end for accepting well fluids, and a rotor suspended from a rod string for rotation, the rotor having a bottom end which extends below the stator's bottom end during pumping and the rotor and rod string having a weight, comprising:

(a) a housing connected to the bottom end of the stator, the housing having a bore;

(b) bearing means located in the housing's bore; and (c) means for supporting the bottom of the rotor and transferring at least a portion of the weight of the rotor and rod string into the bearing means and thus into the housing, stator and tubing string.

2. The rotary tag bar of claim 1 wherein the means for supporting the rotor comprises:

(a) a first shoulder formed in the bore of the housing;

(b) a tubular sleeve residing rotationally within the housing bore and having a second shoulder located above the first shoulder and wherein the bearing means are sandwiched between the first and second shoulders; and (c) a stop formed in the sleeve for supporting the rotor.

3. The rotary tag bar of claim 2 wherein the bearing means comprise at least one thrust bearing.

4. The rotary tag bar of claim 2 further comprising an sleeve annulus formed between the sleeve and the housing wherein:

(a) the at least one thrust bearing is located in the sleeve annulus, sandwiched between the first and second shoulders; and (b) one or more radial bearings fitted in the sleeve annulus.

5. The rotary tag bar of claim 4 further comprising seals in the sleeve annulus, located above and below the one or more thrust bearings and one or more radial bearings, for excluding well fluids.

6. The rotary tag bar of claim 5 further comprising:

(a) a bearing lubricant chamber between the seals;

(b) means for equalizing pressure differential between the lubricant chamber and the well fluids which out admitting well fluids into the lubricant chamber.

7. The rotary tag bar of claim 6 wherein the means for equalizing pressure differential comprises a compensating piston in a cylinder, one side of the piston being exposed to the lubricating chamber and the other side to well fluids.

8. A method for positioning the rotor at the end of a rod string which is extending down a wellbore for connection with and rotation of a rotor in a pump stator, the stator being suspended in the wellbore, comprising the steps of:

(a) hanging a rotating tag bar from the stator, the rotating tag bar having a housing supported from the stator and a rotatable platform;

(b) landing the rotor on the rotatable platform; and (c) lifting the rotor a predetermined distance which is less than the anticipated amount the rod string and rotor will stretch during pumping operation, so that during operation of the pump, the rod string and rotor stretch to contact the rotatable platform and transfer a portion of load produced by the rod string and rotor to the stator.

9. The method of claim 8 further comprising the steps of providing a no-turn tool for anchoring the stator in a wellbore casing so that a portion of the rod string and rotor load is transferred into the casing.

* * * * *